US010036990B2

(12) United States Patent
Adachi

(10) Patent No.: US 10,036,990 B2
(45) Date of Patent: Jul. 31, 2018

(54) IMAGE FORMING SYSTEM AND CONVEYING CONTROL METHOD

(71) Applicant: Konica Minolta, Inc., Chiyoda-ku, Tokyo (JP)

(72) Inventor: Yuki Adachi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/354,393

(22) Filed: Nov. 17, 2016

(65) Prior Publication Data

US 2017/0139367 A1 May 18, 2017

(30) Foreign Application Priority Data

Nov. 18, 2015 (JP) ..... 2015-225600

(51) Int. Cl.
*G03G 15/00* (2006.01)

(52) U.S. Cl.
CPC ..... *G03G 15/6582* (2013.01)

(58) Field of Classification Search
CPC ..... G03G 21/0023
USPC ..... 399/407
See application file for complete search history.

(56) References Cited

U.S. PATENT DOCUMENTS 5,683,556 A * 11/1997 Nomura ..... H05F 3/04 204/164
5,867,760 A * 2/1999 Mitsuoka ..... G03G 15/1685 399/313
7,831,176 B2 * 11/2010 Ishida ..... G03G 21/0064 399/128
2003/0113141 A1 * 6/2003 Saito ..... G03G 15/167 399/302
2008/0013969 A1 * 1/2008 Tomizawa ..... G03G 15/0131 399/44
2012/0069077 A1 * 3/2012 Kaneko ..... B41J 13/223 347/16
2012/0163835 A1 * 6/2012 Sasai ..... G03G 15/0258 399/9

FOREIGN PATENT DOCUMENTS

JP 2013227088 A 11/2013

* cited by examiner

*Primary Examiner* — Anthony Nguyen
(74) *Attorney, Agent, or Firm* — Cantor Colburn LLP

(57) ABSTRACT

An image forming system includes: an image forming unit that forms a toner image on a sheet; a post-processing unit that performs post-processing to the sheet; a conveying unit that conveys the sheet from the image forming unit to the post-processing unit; a discharge member that is arranged between the image forming unit and the post-processing unit in a sheet conveying direction, and discharges static electricity from the sheet conveyed by the conveying unit; a voltage applying unit that applies to the discharge member a discharge voltage for discharging static electricity from the sheet; and a control unit that accelerates a conveying speed of the sheet when the discharge voltage is applied by the voltage applying unit, and controls the conveying unit to vary acceleration timing for accelerating the conveying speed of the sheet in accordance with a type of the post-processing.

9 Claims, 6 Drawing Sheets

IMAGE FORMING SYSTEM AND CONVEYING CONTROL METHOD

The entire disclosure of Japanese Patent Application No. 2015-225600 filed on Nov. 18, 2015 including description, claims, drawings, and abstract are incorporated herein by reference in its entirety.

BACKGROUND OF THE INVENTION

Field of the Invention

The present invention relates to an image forming system and a conveying control method.

Description of the Related Art

An image forming apparatus using electrophotographic process technology (printer, copier, facsimile, or the like) forms an electrostatic latent image by emitting a laser beam based on image data to a photo-conductor charged (exposure), in general. Then, the image forming apparatus visualizes the electrostatic latent image to form a toner image by supplying toner from a developing device to the photo-conductor (image carrier) on which the electrostatic latent image is formed. Further, the image forming apparatus transfers the toner image directly or indirectly to a sheet, and then forms an image on the sheet by heating and pressurizing the toner image with a fixing device for fixing the image. Then, the sheet passing through the fixing device passes through an ejection roller pair for ejection, and is ejected on a sheet ejection tray.

In addition, at time of continuous printing in which image forming is continuously performed to plural sheets, the sheets as plural output objects are stacked and placed on the sheet ejection tray. At this time, in the toner image (toner layer) formed on each sheet on the sheet ejection tray, charge given at time of transfer may remain in the toner layer even after fixing processing, for example. Since the toner layer has a high resistance value, in particular in an image forming apparatus having a fast image forming process speed, the sheet passing through the fixing device is ejected on the sheet ejection tray while sufficient self discharge is not performed. When the plural sheets are continuously stacked and placed on the sheet ejection tray, air between the sheets comes out due to weight of the sheets, and a distance between the toner layers is decreased. As a result, there has been a problem that electrostatic attraction force between the sheets is increased with a lapse of time, and a phenomenon (hereinafter referred to as "ejection sheet sticking phenomenon") is caused in which adjacent sheets are stuck together via the toner image on the sheet. The ejection sheet sticking phenomenon is caused significantly in a case in which a temperature and humidity environment of the image forming apparatus is a low temperature and low humidity environment, or in a case in which a printing mode is a duplex printing mode.

To the above problem, a configuration has been devised in which a discharge device is provided at a downstream side of the fixing device in a sheet conveying direction, and the charge remaining in the toner layer on the sheet is removed. The discharge device includes a configuration including a discharge member (for example, a discharge roller pair capable of sandwiching a sheet), and a discharge voltage applying unit that applies a discharge voltage for discharging static electricity from the sheet to the discharge member.

In JP 2013-227088 A, a sheet loading device has been devised that prevents degradation of image quality due to contact between the sheets while ensuring appropriate loading of the sheet. The sheet loading device described in JP 2013-227088 A applies to a charging unit a correction voltage according to a potential of a sheet before loading onto a loading unit, and controls the charging unit to charge static electricity on the sheet.

In addition, an image forming system has been known in which the above image forming apparatus is connected to a post-processing device, and post-processing, such as center folding processing, binding (saddle stitching, side stitching) processing, is performed to the sheet on which the toner image is formed by the image forming apparatus, and a booklet is created. In the image forming system, to prevent occurrence of the ejection sheet sticking phenomenon after the post-processing, a configuration has been devised in which the discharge member is provided on a sheet conveying path between the image forming apparatus and the post-processing device in the sheet conveying direction, and the charge remaining in the toner layer on the sheet is removed.

In the above image forming system, to gain post-processing time in the post-processing device, a measure is performed in which a space is made between the sheets by accelerating a conveying speed of the sheet from a conveying speed in the image forming apparatus on the sheet conveying path between the image forming apparatus and the post-processing device in the sheet conveying direction. However, in a case in which the sheet is accelerated during discharge of static electricity from the sheet by the discharge member, a value of discharge current (current for canceling the charge on the sheet) flowing to the sheet is not an appropriate value due to application of the discharge voltage to the discharge member during the acceleration, and static electricity in the sheet cannot be sufficiently discharged from an area to which the discharge current not having the appropriate value flows. As a result, there is a problem that the ejection sheet sticking phenomenon occurs in the booklet created by performing the post-processing, and turning a page (sheet) of the booklet is difficult.

In JP 2013-227088 A, although a configuration is described in which the correction voltage according to the potential of the sheet before loading is applied to the charging unit, there is no description or suggestion that the sheet is accelerated during application of the correction voltage. For that reason, the above problem cannot be solved by applying the technology described in JP 2013-227088 A as it is.

SUMMARY OF THE INVENTION

An object of the present invention is to provide an image forming system and a conveying control method capable of preventing that turning a page is difficult of the booklet created by the post-processing.

To achieve the abovementioned object, according to an aspect, an image forming system reflecting one aspect of the present invention comprises:

an image forming unit that forms a toner image on a sheet;

a post-processing unit that performs post-processing to the sheet on which the toner image is formed by the image forming unit;

a conveying unit that conveys the sheet on which the toner image is formed from the image forming unit to the post-processing unit;

a discharge member that is arranged between the image forming unit and the post-processing unit in a sheet conveying direction, and discharges static electricity from the sheet that is conveyed by the conveying unit;

a voltage applying unit that applies to the discharge member a discharge voltage for discharging static electricity from the sheet; and a control unit that accelerates a conveying speed of the sheet when the discharge voltage is applied by the voltage applying unit, and controls the conveying unit to vary acceleration timing for accelerating the conveying speed of the sheet in accordance with a type of the post-processing.

To achieve the abovementioned object, according to an aspect, there is provided a conveying control method in an image forming system comprising:

an image forming unit that forms a toner image on a sheet;

a post-processing unit that performs post-processing to the sheet on which the toner image is formed by the image forming unit;

a conveying unit that conveys the sheet on which the toner image is formed from the image forming unit to the post-processing unit;

a discharge member that is arranged between the image forming unit and the post-processing unit in a sheet conveying direction, and discharges static electricity from the sheet that is conveyed by the conveying unit; and a voltage applying unit that applies to the discharge member a discharge voltage for discharging static electricity from the sheet, and the conveying control method reflecting one aspect of the present invention comprises controlling the conveying unit, when the discharge voltage is applied by the voltage applying unit, to accelerate a conveying speed of the sheet, and to vary acceleration timing for accelerating the conveying speed of the sheet in accordance with a type of the post-processing.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
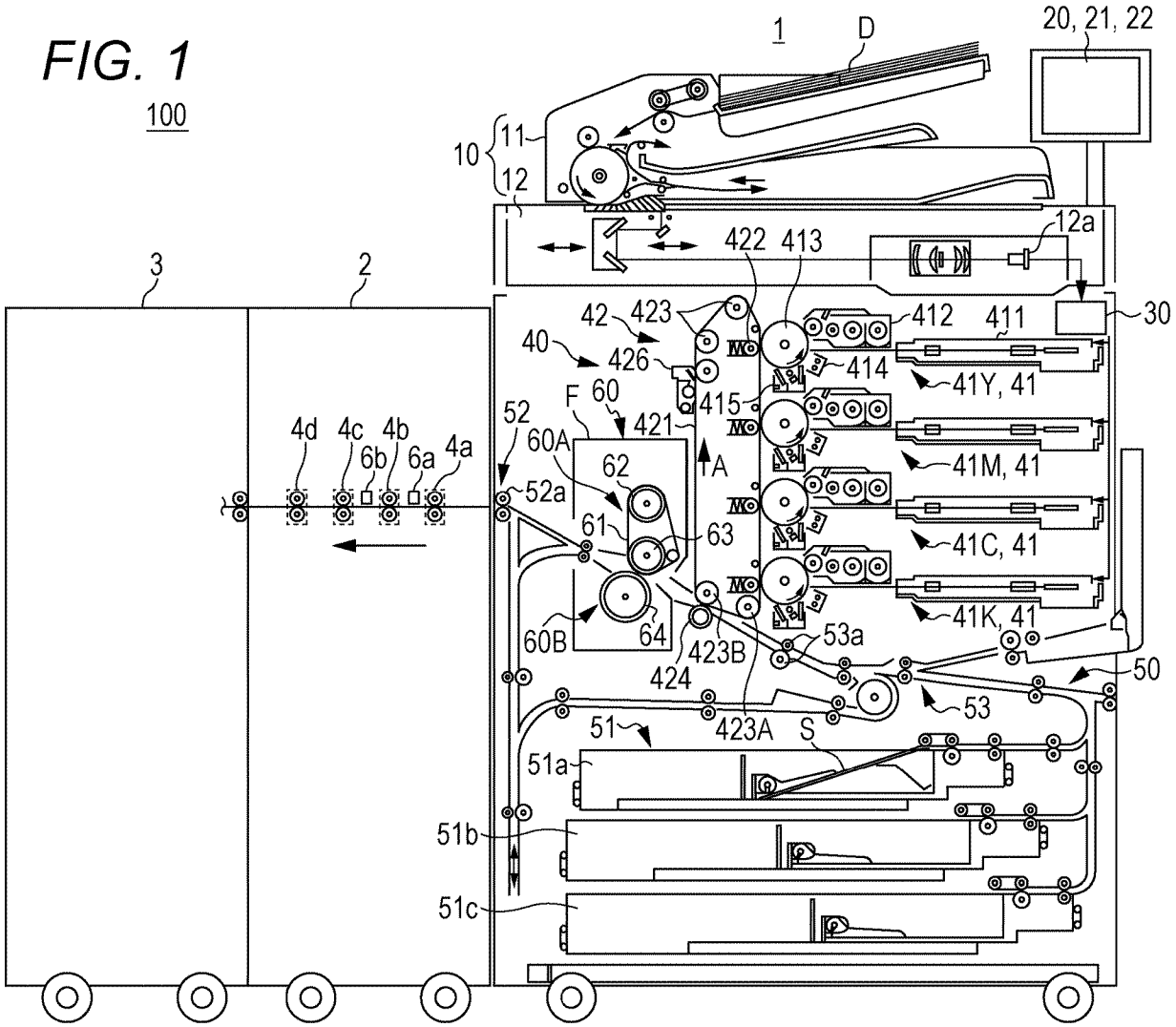
FIG. 1 is a diagram schematically illustrating an entire configuration of an image forming system according to a present embodiment.
Figure 2:
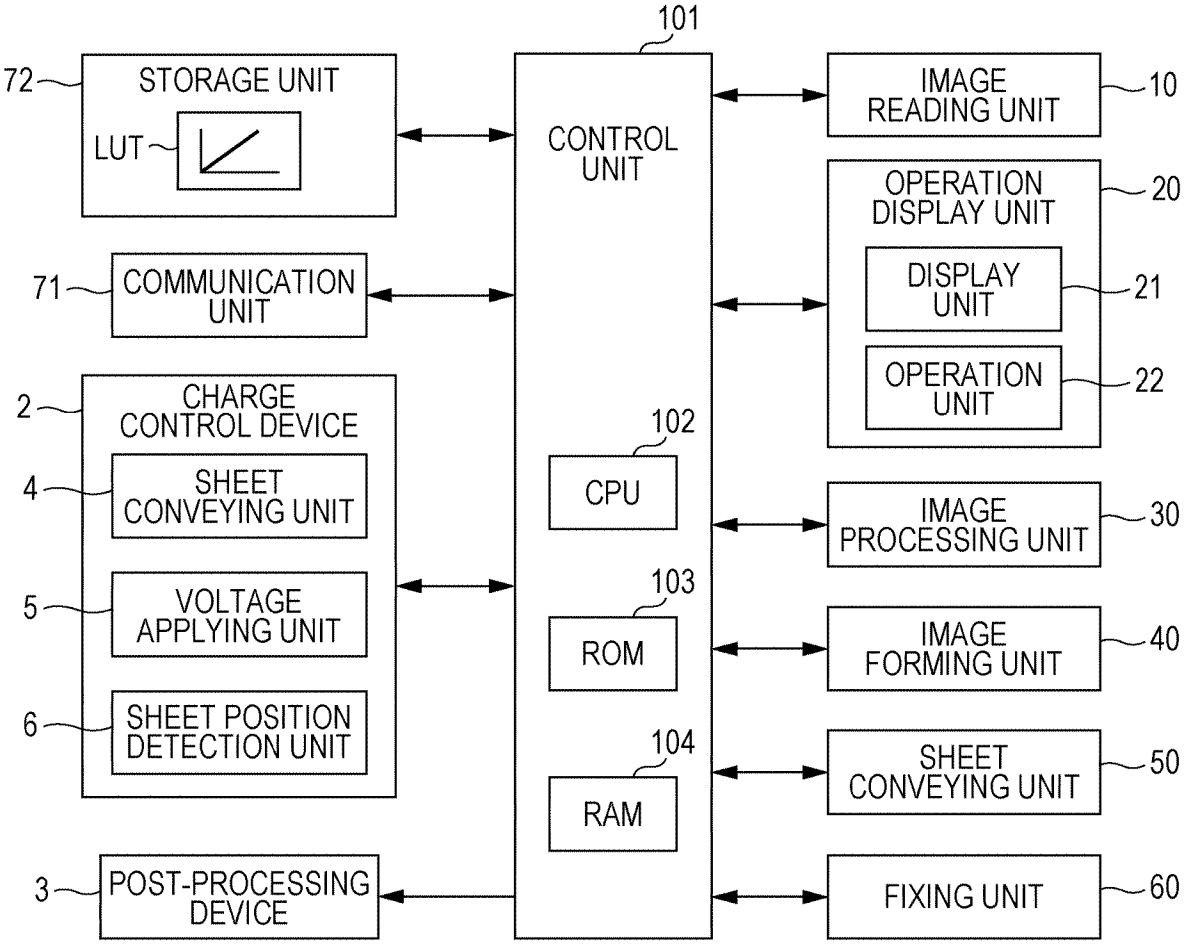
FIG. 2 is a diagram illustrating major units of a control system of an image forming apparatus according to the present embodiment.

Hereinafter, an embodiment of the present invention will be described in detail with reference to the drawings. However, the scope of the invention is not limited to the illustrated examples. FIG. 1 is a diagram schematically illustrating an entire configuration of an image forming system 100 according to the present embodiment. FIG. 2 illustrates major units of a control system of an image forming apparatus 1 included in the image forming system 100 according to the present embodiment.

As illustrated in FIG. 1, the image forming system 100 is configured by the image forming apparatus 1 (functions as "image forming unit" of the present invention), a charge control device 2, and a post-processing device 3 (functions as "post-processing unit" of the present invention) that are connected together from an upstream side along a conveying direction of a sheet S (hereinafter also referred to as "sheet conveying direction").

The image forming apparatus 1 is a color image forming apparatus of an intermediate transfer system using an electrophotographic process technology. That is, the image forming apparatus 1 forms a toner image by performing primary transfer of each color toner image of yellow (Y), magenta (M), cyan (C), black (K) formed on a photoconductor drum 413 to an intermediate transfer belt 421, and laying over the toner images of four colors on the intermediate transfer belt 421, and then performing secondary transfer to the sheet S sent from sheet feeding tray units 51*a* to 51*c*.

In addition, in the image forming apparatus 1, a tandem system is adopted in which photo-conductor drums 413 respectively corresponding to four colors of Y, M, C, K are serially arranged in a traveling direction of the intermediate transfer belt 421, and each color toner image is sequentially transferred to the intermediate transfer belt 421 in a single procedure.

As illustrated in FIG. 2, the image forming apparatus 1 includes an image reading unit 10, an operation display unit 20, an image processing unit 30, an image forming unit 40, a sheet conveying unit 50, a fixing unit 60, and a control unit 101.

The control unit 101 includes a central processing unit (CPU) 102, read only memory (ROM) 103, random access memory (RAM) 104. The CPU 102 reads a program according to processing details from the ROM 103 and deploys the program on the RAM 104, and centrally controls operation of each block and the like of the image forming apparatus 1 cooperating with the program deployed. At this time, various types of data stored in a storage unit 72 are referenced. The storage unit 72 is configured by, for example, a nonvolatile semiconductor memory (so-called flash memory) or a hard disk drive.

The control unit 101 performs transmission and reception of various types of data with an external device (for example, a personal computer) connected to a communication network such as a local area network (LAN), or a wide area network (WAN), via a communication unit 71. The control unit 101 receives image data transmitted from the external device, for example, and forms an image on the sheet S on the basis of the image data (input image data). The communication unit 71 is configured by, for example, a communication control card such as a LAN card.

The image reading unit 10 is configured to include an automatic document sheet feeding device 11 that is referred to as an auto document feeder (ADF), and a document image scanning device 12 (scanner).

The automatic document sheet feeding device 11 conveys a document D placed on a document tray with a conveying mechanism, and sends the document to the document image scanning device 12. With the automatic document sheet feeding device 11, it is possible to read continuously at once the image (including both sides) of a large number of sheets of the document D placed on the document tray.

The document image scanning device 12 optically scans the document conveyed onto a contact glass from the automatic document sheet feeding device 11 or the document placed on the contact glass, and focuses reflected light from the document on a light receiving surface of a charge coupled device (CCD) sensor 12*a*, and reads a document image. The image reading unit 10 generates input image data on the basis of a reading result by the document image scanning device 12. To the input image data, predetermined image processing is performed in the image processing unit 30.

The operation display unit 20 is configured by a liquid crystal display (LCD) with a touch panel, for example, and functions as a display unit 21 and an operation unit 22. The display unit 21 displays various types of operation screens, a state of the image, operating conditions of the functions, and the like, in accordance with a display control signal input from the control unit 101. The operation unit 22 includes various types of operation keys such as a ten key, and a start key, and receives various types of input operations by a user, and outputs an operation signal to the control unit 101. Information of various types of instructions and settings performed by the user is handled by the control unit 101 as job information. The job information includes a sheet size, a number of prints, necessary post-processing, and a number of sheets per booklet (in a case of performing binding processing). Incidentally, the job information relating to post-processing operation of the post-processing device 3 is transferred from the image forming apparatus 1 to the post-processing device 3.

The image processing unit 30 includes a circuit for performing digital image processing according to an initial setting or a user setting, to the input image data. For example, the image processing unit 30 performs tone correction on the basis of tone correction data (tone correction table) under control of the control unit 101. In addition, the image processing unit 30 performs to the input image data various types of correction processing or compression processing such as color correction, shading correction, besides the tone correction. The image forming unit 40 is controlled on the basis of the image data to which the processing is performed.

The image forming unit 40 includes an intermediate transfer unit 42, and image forming units 41Y, 41M, 41C, 41K for forming images formed by color toners of Y, M, C, K components respectively on the basis of the input image data.

The image forming units 41Y, 41M, 41C, 41K for the respective Y, M, C, K components have similar configurations. For convenience of illustration and description, common constituents are denoted by the same reference numerals, and in a case in which the constituents are distinguished from each other, the constituents are denoted by adding Y, M, C, or K to the reference numerals. In FIG. 1, the reference numeral is given to only the constituent of the image forming unit 41Y for the Y component, and the reference numerals for the constituents of other image forming units 41M, 41C, 41K are omitted.

The image forming unit 41 includes an exposure device 411, a developing device 412, a photo-conductor drum 413, a charging device 414, and a drum cleaning device 415.

The photo-conductor drum 413 is, for example, a negative charge type organic photo-conductor (OPC) in which an under coat layer (UCL), a charge generation layer (CGL), and a charge transport layer (CTL) are sequentially layered on a peripheral surface of an aluminum conductive cylindrical body (aluminum raw tube) of a drum diameter of 80 [mm]. The CGL is made of an organic semiconductor in which a charge generation material (for example, phthalocyanine pigment) is dispersed in a resin binder (for example, polycarbonate), and the CGL generates a pair of positive and negative charges by exposure by the exposure device 411. The CTL is made of a substance in which a hole transporting material (electron-donating nitrogen-containing compound) is dispersed in a resin binder (for example, polycarbonate resin), and the CTL transports the positive charge generated in the CGL to a surface of the CTL.

The control unit 101 rotates the photo-conductor drum 413 at a constant circumferential speed by controlling a drive current to be supplied to a drive motor (not illustrated) for rotating the photo-conductor drum 413.

The charging device 414 uniformly charges negatively a surface of the photo-conductor drum 413 having photoconductivity. The exposure device 411 is configured by a semiconductor laser, for example, and emits a laser beam corresponding to each color component image to the photo-conductor drum 413. The positive charge is generated in the CGL of the photo-conductor drum 413, and is transported to the surface of the CTL, whereby a surface charge (negative charge) of the photo-conductor drum 413 is neutralized. On the surface of the photo-conductor drum 413, each color component electrostatic latent image is formed due to a potential difference from a periphery.

The developing device 412 is a developing device of a two-component developing system, and visualizes the electrostatic latent image by allowing each color component toner to adhere to the surface of the photo-conductor drum 413, to form the toner image.

The drum cleaning device 415 has a drum cleaning blade that is slidably in contact with the surface of the photo-conductor drum 413, and the like, and removes transfer residual toner remaining on the surface of the photo-conductor drum 413 after the primary transfer.

The intermediate transfer unit 42 includes an intermediate transfer belt 421, a primary transfer roller 422, plural support rollers 423, a secondary transfer roller 424, and a belt cleaning device 426.

The intermediate transfer belt 421 is configured by an endless belt, and is stretched by the plural support rollers 423 in a loop shape. At least one of the plural support rollers 423 is configured by a drive roller, and the other is configured by a driven roller. For example, a roller 423A is preferably the drive roller, which is arranged at a belt traveling direction downstream side from the primary transfer roller 422 for the K component. Thus, it is easy to hold a traveling speed constant of the belt in a primary transfer section. By rotation of the drive roller 423A, the intermediate transfer belt 421 travels at a constant speed in an arrow A direction.

The intermediate transfer belt 421 is a belt having conductivity and elasticity, and has a high-resistivity layer of a volume resistivity of 8 to 11 [log Ω·cm] on the surface. The intermediate transfer belt 421 is rotationally driven by a control signal from the control unit 101. Incidentally, material, thickness and hardness for the intermediate transfer belt 421 are not limited, as far as it has conductivity and elasticity.

The primary transfer roller 422 is a roller in which a core bar is coated by foam. As the foam, ion conductive NBR (rubber material) and hydrin rubber foam sponge are used. The primary transfer roller 422 is arranged at an inner circumferential surface side of the intermediate transfer belt 421 facing each color component photo-conductor drum 413. The primary transfer roller 422 is pressed against the photo-conductor drum 413 sandwiching the intermediate transfer belt 421, whereby a primary transfer nip is formed for transferring the toner image from the photo-conductor drum 413 to the intermediate transfer belt 421.

The secondary transfer roller 424 is a roller in which a core bar is coated by foam, similarly to the primary transfer roller 422. As the foam, ion conductive NBR (rubber material) and hydrin rubber foam sponge are used. The secondary transfer roller 424 is arranged at an outer circumferential surface side of the intermediate transfer belt 421 facing a backup roller 423B arranged at the belt traveling direction downstream side of the drive roller 423A. The secondary transfer roller 424 is pressed against the backup roller 423B sandwiching the intermediate transfer belt 421, whereby a secondary transfer nip is formed for transferring the toner image from the intermediate transfer belt 421 to the sheet S.

When the intermediate transfer belt 421 passes through the primary transfer nip, primary transfer of the toner image on the photo-conductor drum 413 is performed sequentially to be overlaid to the intermediate transfer belt 421. Specifically, a primary transfer voltage is applied to the primary transfer roller 422, and a charge having a reverse polarity to the toner is given to a back surface side of the intermediate transfer belt 421 (a contact side with the primary transfer roller 422), whereby the toner image is electrostatically transferred to the intermediate transfer belt 421.

After that, when the sheet S passes through the secondary transfer nip, secondary transfer of the toner image on the intermediate transfer belt 421 is performed to the sheet S. Specifically, a secondary transfer voltage is applied to the secondary transfer roller 424, and the charge having the reverse polarity to the toner is given to a back surface side of the sheet S (a contact side with the secondary transfer roller 424), whereby the toner image is electrostatically transferred to the sheet S. The sheet S on which the toner image is transferred is conveyed toward the fixing unit 60.

The belt cleaning device 426 removes transfer residual toner remaining on a surface of the intermediate transfer belt 421 after the secondary transfer. Incidentally, instead of the secondary transfer roller 424, a configuration (so-called belt type secondary transfer unit) may be adopted in which secondary transfer belt is stretched in a loop shape across plural support rollers including the secondary transfer roller.

The fixing unit 60 includes an upper fixing unit 60A having a fixing surface side member arranged at a fixing surface (surface on which the toner image is formed) side of the sheet S, and a lower fixing unit 60B having a back surface side support member arranged at a back surface (reverse surface to the fixing surface) side of the sheet S. The back surface side support member is pressed against the fixing surface side member, whereby a fixing nip is formed for sandwiching and conveying the sheet S.

The fixing unit 60 fixes the toner image to the sheet S by heating and pressing with the fixing nip the sheet S on which the secondary transfer of the toner image is performed and that is conveyed. The fixing unit 60 is arranged as a unit in a fixing device F. In addition, in the fixing device F, air separation unit may be arranged for separating the sheet S from the fixing surface side member or the back surface side support member by an air blow.

The upper fixing unit 60A has an endless fixing belt 61 that is the fixing surface side member, a heating roller 62, and a fixing roller 63 (belt heating system). The fixing belt 61 is stretched by the heating roller 62 and the fixing roller 63 at a predetermined belt tension (for example, 40 [N]).

The fixing belt 61 contacts the sheet S on which the toner image is formed to perform heat-fixing of the toner image onto the sheet S at a fixing temperature (for example, 160 to 200 [° C.]). Here, the fixing temperature is a temperature that can supply an amount of heat necessary to melt the toner on the sheet S, and varies depending on a sheet type of the sheet S on which the image is formed, and the like.

The heating roller 62 has a built-in heat source (halogen heater), and heats the fixing belt 61. The heating roller 62 is heated by continuous lighting of the heat source, and as a result, the fixing belt 61 is heated.

The fixing roller 63 has a configuration in which an elasticity layer (for example, thickness: 10 [mm]) made of silicone rubber and the like, and a surface layer (for example, thickness: 70 [μm]) made of fluorine-based resin such as PTFE are sequentially layered and formed, on an outer circumferential surface of a cylindrical core bar made of aluminum and the like, for example. Drive control (for example, on/off of rotation, circumferential speed) of the fixing roller 63 is performed by the control unit 101. The control unit 101 rotates the fixing roller 63 in a clockwise direction. By rotation of the fixing roller 63, the fixing belt 61 and the heating roller 62 is driven to rotate in a clockwise direction.

The lower fixing unit 60B has a pressing roller 64 that is the back surface side support member (roller pressing system). The pressing roller 64 has a configuration in which an elasticity layer made of silicone rubber and the like, and a surface layer made of a PFA tube are sequentially layered and formed, on an outer circumferential surface of a cylindrical core bar made of iron and the like, for example. Between the fixing belt 61 and the pressing roller 64, the fixing nip is formed for sandwiching and conveying the sheet S. Drive control (for example, on/off of rotation, circumferential speed) of the pressing roller 64 is performed by the control unit 101. The control unit 101 rotates the pressing roller 64 in a counterclockwise direction.

The sheet conveying unit 50 includes a sheet feeding unit 51, a sheet ejection unit 52, and a conveying path unit 53. In the three sheet feeding tray units 51*a* to 51*c* configuring the sheet feeding unit 51, the sheet S (standard sheet, special sheet) identified on the basis of a basis weight or a size is accommodated for each type set in advance. The conveying path unit 53 has plural conveying roller pairs including a resist roller pair 53*a*. A resist roller unit in which the resist roller pair 53*a* is provided corrects inclination and deviation of the sheet S.

The sheet S accommodated in the sheet feeding tray units 51*a* to 51*c* is sent one by one from the top, and conveyed to the image forming unit 40 by the conveying path unit 53. In the image forming unit 40, secondary transfer of the toner image of the intermediate transfer belt 421 is collectively performed to one surface of the sheet S, and fixing process is performed in the fixing unit 60. The sheet S on which the image is formed is conveyed to the charge control device 2 by the sheet ejection unit 52 including an ejection roller pair 52*a*.

The charge control device 2, to prevent occurrence of the ejection sheet sticking phenomenon after the post-processing by the post-processing device 3, removes the charge remaining in the toner layer on the sheet S on which the toner image is formed by the image forming apparatus 1, and conveys the sheet to the post-processing device 3. The charge control device 2 includes a sheet conveying unit 4 (functions as "conveying unit" of the present invention), a voltage applying unit 5, and a sheet position detection unit 6.

The sheet conveying unit 4 has plural conveying roller pairs 4*a*, 4*c*, 4*d*, and conveys the sheet S ejected from the sheet ejection unit 52 of the image forming apparatus 1 to the post-processing device 3. Drive control (for example, on/off of rotation, circumferential speed) of the conveying roller pairs 4*a*, 4*c*, 4*d* is performed by the control unit 101.

Between the conveying roller pair 4*a* and the conveying roller pair 4*c* in the sheet conveying direction, a discharge roller pair 4*b* is arranged that functions as a discharge member for discharging static electricity from the sheet S that is conveyed by the conveying roller pairs 4*a*, 4*c*, 4*d*. The discharge roller pair 4*b* is configured to be rotated in only one direction (clockwise direction) bypassing of the sheet S through the conveying nip formed by the discharge roller pair 4*b*.

The voltage applying unit 5 receives control of the control unit 101, and applies a discharge voltage for discharging static electricity from the sheet S to the discharge roller pair 4*b*.

The sheet position detection unit 6 has sheet position detection sensors 6*a*, 6*b* respectively provided at an upstream side and a downstream side of the discharge roller pair 4*b* in the sheet conveying direction. The sheet position detection sensors 6*a*, 6*b*, when detecting passing of the sheet S that is conveyed, outputs a signal of that effect (hereinafter referred to as "sheet detection signal") to the control unit 101. Each of the sheet position detection sensors 6*a*, 6*b* is configured by, for example, a reflective photo sensor; however, it is not limited thereto, and the detection system does not matter as far as the sensor is capable of detecting that the sheet S passes through.

The post-processing device 3 receives control of the control unit 101, and performs the post-processing to the sheet S conveyed from the charge control device 2 and creates a booklet. The post-processing includes center folding processing, and binding (saddle stitching, side stitching) processing.

Figure 3:
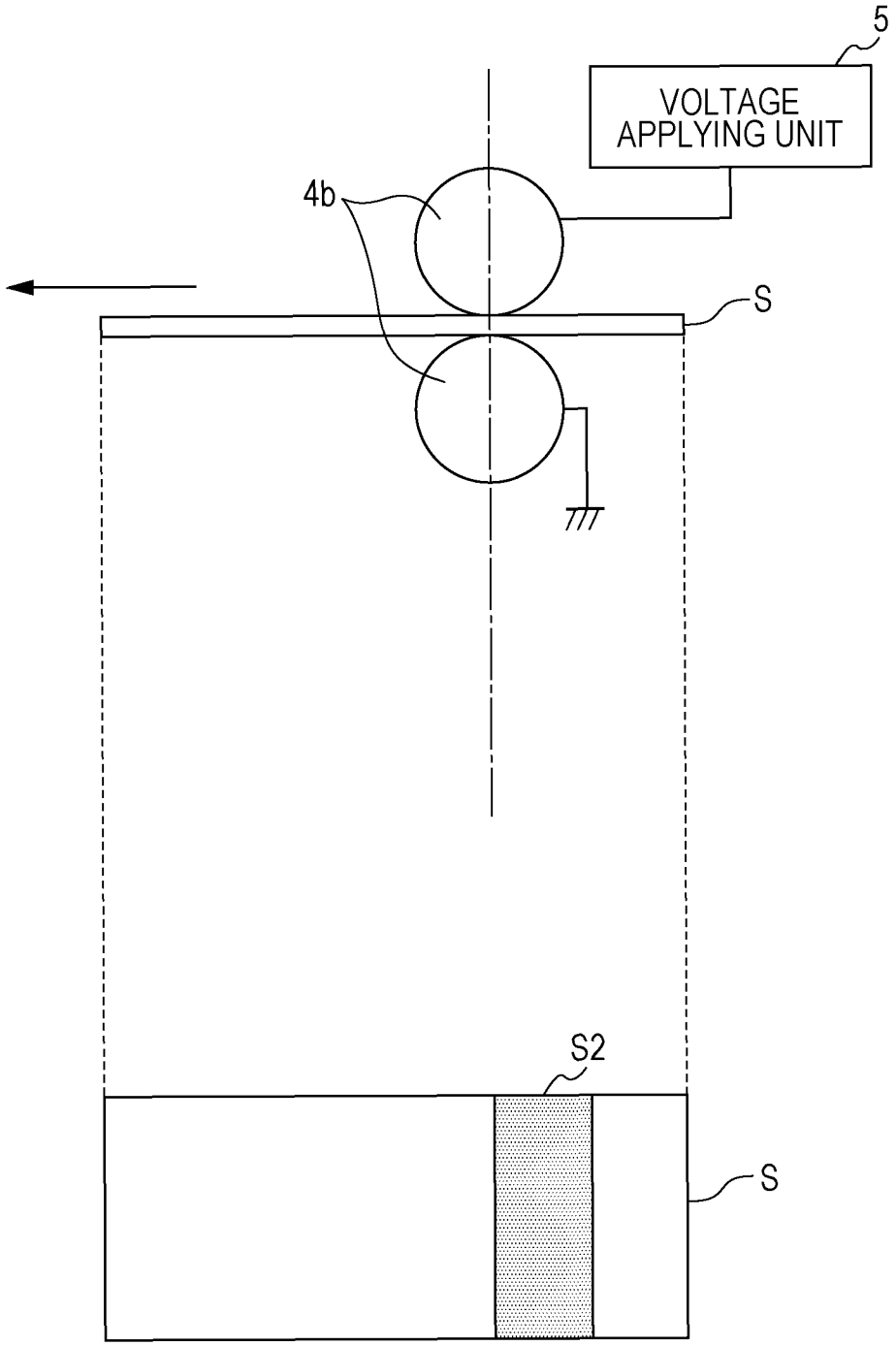
FIG. 3 is a diagram for explaining an acceleration area to which a discharge current having not an appropriate value flows.

In the image forming system 100, to gain post-processing time in the post-processing device 3, a measure is performed in which a space is made between the sheets by accelerating a conveying speed of the sheet S from a conveying speed in the image forming apparatus 1 on the sheet conveying path between the image forming apparatus 1 and the post-processing device 3 in the sheet conveying direction (specifically, increasing the circumferential speed of the conveying roller pairs 4*a*, 4*c*, 4*d*). However, in a case in which the sheet S is accelerated during discharge of static electricity from the sheet S by the discharge roller pair 4*b*, a value of discharge current (current for canceling the charge on the sheet S) flowing to the sheet S is not an appropriate value due to application of the discharge voltage to the discharge roller pair 4*b* during the acceleration, and static electricity in the sheet S cannot be sufficiently discharged from an area (hereinafter referred to as "acceleration area." see an area S2 of FIG. 3) to which the discharge current not having the appropriate value flows. As a result, in the booklet created by performing the post-processing, there is a possibility that the ejection sheet sticking phenomenon occurs in the acceleration area of each sheet S configuring the booklet, and turning a page (sheet S) of the booklet is difficult.

Therefore, in the present embodiment, the control unit 101 controls the sheet conveying unit 4 so that, when the discharge voltage is applied to the discharge roller pair 4*b* by the voltage applying unit 5, the conveying speed of the sheet S is accelerated, and acceleration timing for accelerating the conveying speed of the sheet S is varied in accordance with a type of the post-processing that is performed in the post-processing device 3.

For example, in a case in which the type of the post-processing is the saddle stitching processing or the center folding processing, the control unit 101, on the basis of the sheet size information, the sheet detection signal output from the sheet position detection sensors 6*a*, 6*b*, and the like, controls the sheet conveying unit 4 so that the above acceleration timing coincides with timing at which static electricity is discharged by the discharge roller pair 4*b* from an area of the sheet S, the area including a folding portion provided by the saddle stitching processing or the center folding processing.

Figure 4:
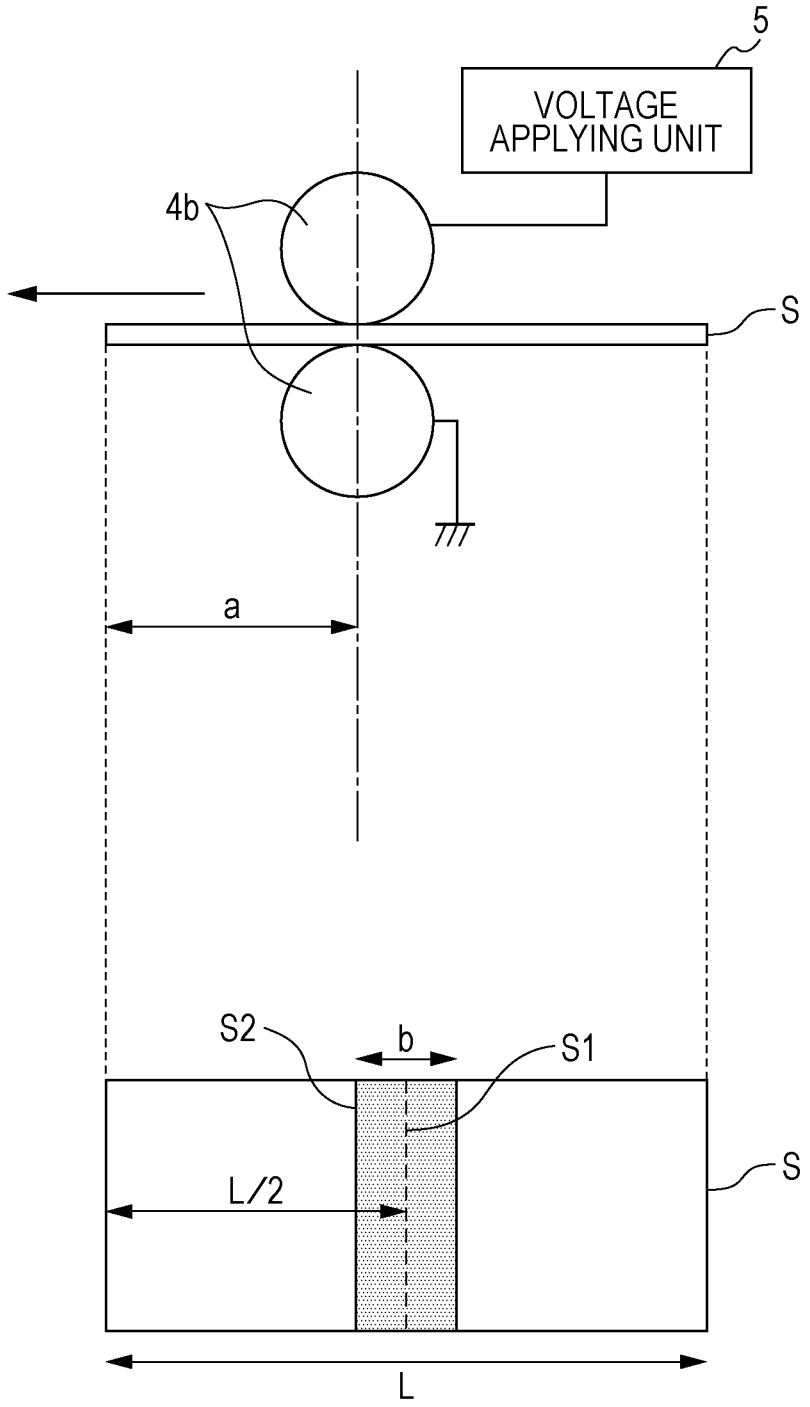
FIG. 4 is a diagram for explaining an acceleration area in a case in which a type of post-processing is saddle stitching processing or center folding processing.

As illustrated in FIG. 4, the control unit 101 controls the sheet conveying unit 4 so that the above acceleration timing coincides with timing at which static electricity is discharged by the discharge roller pair 4*b* from the area S2 (acceleration area) of the sheet S, the area S2 including a folding portion S1 provided by the saddle stitching processing or the center folding processing. In FIG. 4, among a length L of the sheet S in the sheet conveying direction, a distance a from an edge position of the sheet S to an edge position of the area S2, and a length b of the area S2, a relationship represented in the following formula (1) is satisfied.

$$L/2=a+b/2 \quad (1)$$

That is, the control unit 101 performs acceleration control of the sheet S so that the folding portion S1 of the sheet S is a center position of the acceleration area S2 (area to which discharge current not being the appropriate value flows), the folding portion S1 being provided by the saddle stitching processing or the center folding processing. As a result, it can be prevented that a place in which the ejection sheet sticking phenomenon occurs is near the folding portion S1 of the sheet S, and turning a page is difficult of the booklet created by the saddle stitching processing or the center folding processing.

In addition, in a case in which the type of the post-processing is the side stitching processing, the control unit 101, on the basis of the sheet detection signal output from the sheet position detection sensors 6*a*, 6*b*, the sheet size information, and the like, controls the sheet conveying unit 4 so that the above acceleration timing coincides with timing at which static electricity is discharged by the discharge roller pair 4*b* from an area in a binding portion side of the sheet S, the area being provided by the side stitching processing.

Figure 5:
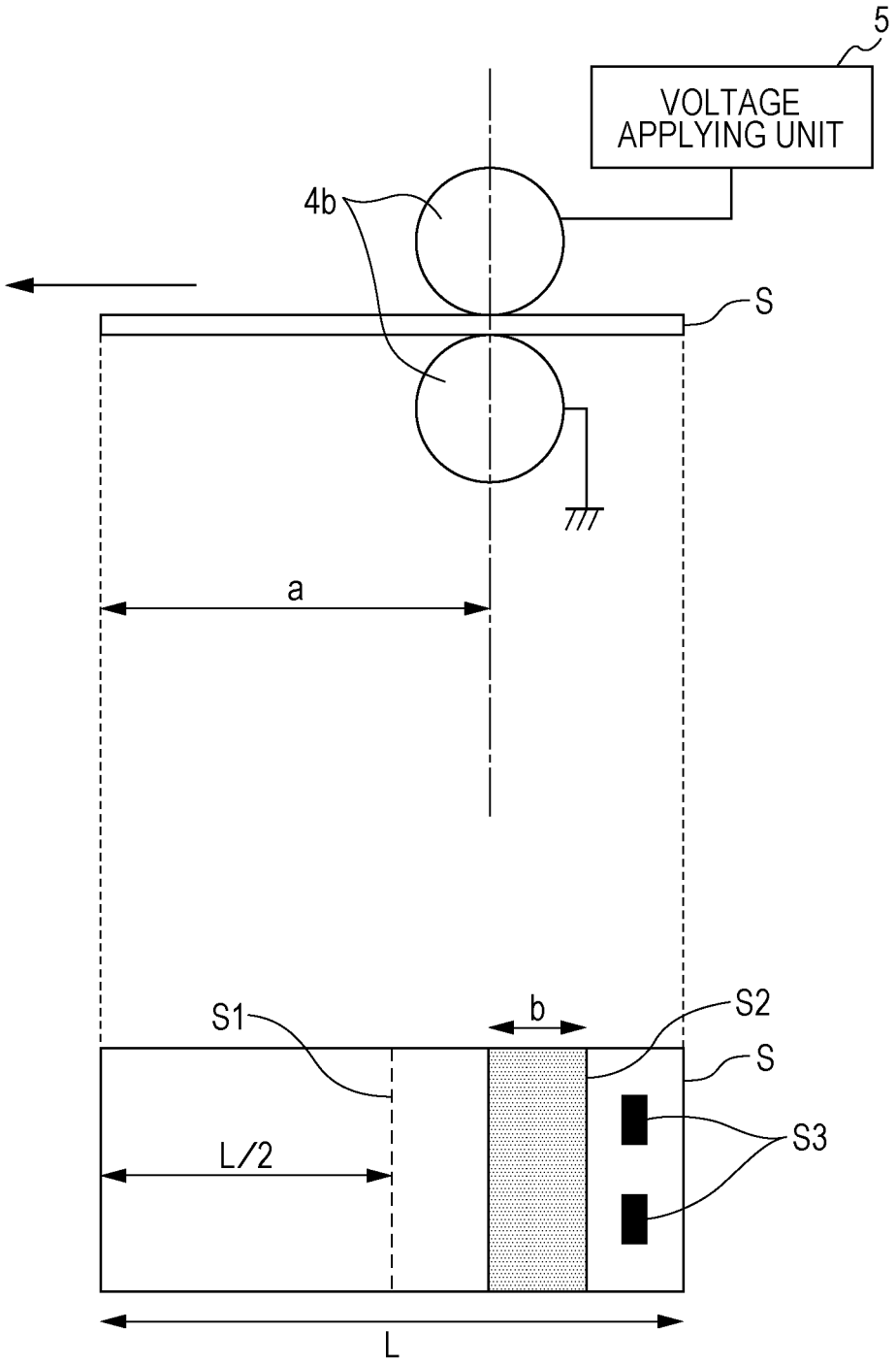
FIG. 5 is a diagram for explaining an acceleration area in a case in which the type of the post-processing is side stitching processing.

As illustrated in FIG. 5, the control unit 101 controls the sheet conveying unit 4 so that the above acceleration timing coincides with timing at which static electricity is discharged by the discharge roller pair 4*b* from the area S2 (acceleration area) of a binding portion S3 side of the sheet S, the binding portion S3 being provided by the side stitching processing. In FIG. 5, between the length L of the sheet S in the sheet conveying direction and the distance a from the edge position of the sheet S to the edge portion of the area S2, a relationship represented in the following formula (2) is satisfied.

$$L/2<a \quad (2)$$

That is, the control unit 101 performs acceleration control of the sheet S so that the acceleration area S2 (area to which discharge current not being the appropriate value flows) is positioned near the binding portion S3 of the sheet S, the binding portion S3 being provided by the side stitching processing. As a result, it can be prevented that the place in which the ejection sheet sticking phenomenon occurs is near the binding portion S3 of the sheet S, and turning a page is difficult of the booklet created by the side stitching processing.

Figure 6:
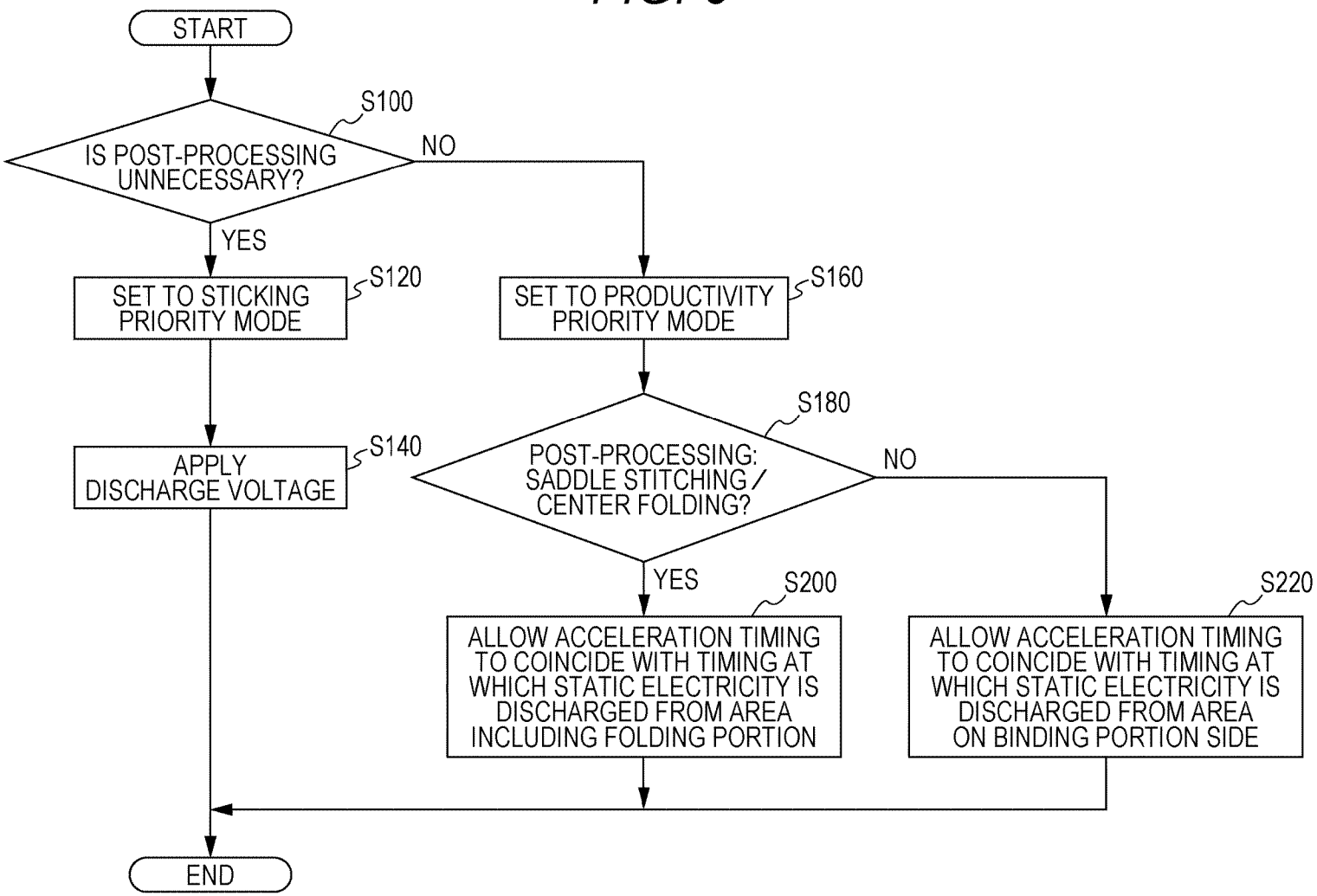
FIG. 6 is a flowchart illustrating control operation in the image forming system according to the present embodiment.

Next, a control operation example will be described of the image forming system 100 according to the present embodiment with reference to a flowchart of FIG. 6. The control operation illustrated in FIG. 6 is executed after the control unit 101 receives an execution instruction of a printing job.

First, the control unit 101 refers to the job information of the printing job, and determines whether the post-processing is not necessary (step S100). In a case in which the post-processing is not necessary (step S100, YES), the control unit 101 sets an operation mode of the charge control device 2 to a sticking priority mode (corresponding to "constant speed mode" of the present invention) (step S120). The sticking priority mode is a mode in which the conveying speed of the sheet S is not accelerated when the discharge voltage is applied to the discharge roller pair 4*b* by the voltage applying unit 5.

Finally, the control unit 101 controls the voltage applying unit 5, and applies the discharge voltage for discharging static electricity from the sheet S to the discharge roller pair 4*b* (step S140). Thus, the charge remaining in the toner layer of an entire of the sheet S can be removed, and occurrence of the ejection sheet sticking phenomenon can be reliably prevented. By completing processing of step S140, the image forming system 100 ends processing in FIG. 6.

On the other hand, in a case in which the post-processing is necessary (step S100, NO), the control unit 101 sets the operation mode of the charge control device 2 to a productivity priority mode (corresponding to "acceleration mode" of the present invention) (step S160). The productivity priority mode is a mode in which the conveying speed of the sheet S is accelerated when the discharge voltage is applied to the discharge roller pair 4*b* by the voltage applying unit 5.

Next, the control unit 101 determines whether the type of the post-processing is the saddle stitching processing or the center folding processing (step S180). As a result of determination, in a case in which the type of the post-processing is the saddle stitching processing or the center folding processing (step S180, YES), the control unit 101, on the basis of the sheet size information, the sheet detection signal output from the sheet position detection sensors 6*a*, 6*b*, and the like, controls the sheet conveying unit 4 so that the acceleration timing for accelerating the conveying speed of the sheet S coincides with timing at which static electricity is discharged by the discharge roller pair 4*b* from the area of the sheet S, the area including the folding portion provided by the saddle stitching processing or the center folding processing (step S200). By completing processing of step S200, the image forming system 100 ends the processing in FIG. 6.

On the other hand, in a case in which the type of the post-processing is not the saddle stitching processing or the center folding processing, that is, the type of the post-processing is the side stitching processing in the present embodiment (step S180, NO), the control unit 101, on the basis of the sheet size information, the sheet detection signal output from the sheet position detection sensors 6*a*, 6*b*, and the like, controls the sheet conveying unit 4 so that the above acceleration timing coincides with timing at which static electricity is discharged by the discharge roller pair 4*b* from the area in the binding portion side of the sheet S, the binding portion being provided by the side stitching processing (step S220). By completing processing of step S220, the image forming system 100 ends the processing in FIG. 6.

As described above in detail, in the present embodiment, the image forming system 100 includes: the image forming unit (image forming apparatus 1) that forms the toner image on the sheet S; the post-processing unit (post-processing device 3) that performs post-processing to the sheet S on which the toner image is formed by the image forming unit; the conveying unit (sheet conveying unit 4) that conveys the sheet S on which the toner image is formed from the image forming unit to the post-processing unit; the discharge member (discharge roller pair 4*b*) that is arranged between the image forming unit and the post-processing unit in the sheet conveying direction, and discharges static electricity from the sheet that is conveyed by the conveying unit; the voltage applying unit 5 that applies the discharge voltage for discharging static electricity from the sheet S to the discharge member; and the control unit 101 that accelerates the conveying speed of the sheet S when the discharge voltage is applied by the voltage applying unit 5, and controls the conveying unit to vary the acceleration timing for accelerating the conveying speed of the sheet S in accordance with the type of the post-processing.

According to the present embodiment thus configured, even when the sheet S is accelerated during discharge of static electricity from the sheet S by the discharge member, the place in which the ejection sheet sticking phenomenon occurs is controlled if appropriate to be in a place in which turning a page is not difficult of the booklet created by the post-processing. For that reason, regardless of the type of the post-processing, it can be prevented that turning a page is difficult of the booklet created by the post-processing (in other words, the booklet is difficult to be opened).

Incidentally, in the above embodiment, the control unit 101 may determine whether to vary the above acceleration timing in accordance with the type of the sheet S. For example, the control unit 101, in a case in which the type of the sheet S is a type (coated sheet, large basis weight) in which the ejection sheet sticking phenomenon easily occurs, varies the acceleration timing, but, on the other hand, in a case of a type in which the ejection sheet sticking phenomenon is difficult to occur (non-coated sheet, small basis weight), does not have to vary the acceleration timing.

In addition, in the above embodiment, the control unit 101 may determine whether to vary the above acceleration timing in accordance with coverage of the toner image formed on the sheet S. For example, the control unit 101, in a case in which the coverage is large (that is, the ejection sheet sticking phenomenon easily occurs), varies the acceleration timing, but, on the other hand, in a case in which the coverage is small (that is, the ejection sheet sticking phenomenon is difficult to occur), does not have to vary the acceleration timing.

In addition, in the above embodiment, the control unit 101 may determine whether to apply the discharge voltage to the discharge roller pair 4*b* at the above acceleration timing in accordance with change of the conveying speed between before and after accelerating the conveying speed of the sheet S. For example, the control unit 101, in a case in which the change of the conveying speed is large between before and after accelerating the conveying speed of the sheet S (for example, from 150 [mm/s] to 1000 [mm/s]), does not apply the discharge voltage to the discharge roller pair 4*b* at the above acceleration timing, but, on the other hand, in a case in which the change of the conveying speed is small, applies the discharge voltage to the discharge roller pair 4*b* at the above acceleration timing. This is because, in a case in which the change of the conveying speed of the sheet S is large, there is a possibility that the discharge current flowing to the sheet S cannot be controlled, and sticking force in the sheet S is excessively increased in the place in which the ejection sheet sticking phenomenon occurs (that is, the sticking force is larger than that in a case in which the discharge voltage is not applied to the discharge roller pair 4*b*).

In addition, in the above embodiment, an example has been described in which the operation mode of the charge control device 2 is always set to the productivity priority mode in a case in which the post-processing is necessary; however, in a case in which there is a possibility that the sticking force in the sheet S is excessively increased in the place in which the ejection sheet sticking phenomenon occurs by accelerating the conveying speed of the sheet S when the discharge voltage is applied to the discharge roller pair 4*b*, the operation mode of the charge control device 2 may be set to the sticking priority mode in which conveying speed of the sheet S is not accelerated, not to the productivity priority mode.

Although the present invention has been described and illustrated in detail, it is clearly understood that the same is by way of illustrated and example only and is not to be taken by way of limitation, the scope of the present invention being interpreted by terms of the appended claims. That is, the present invention can be implemented in various forms without departing from the gist or main features thereof.

What is claimed is:

1. An image forming system comprising:

an image forming unit that forms a toner image on a sheet;

a post-processing unit that performs post-processing to the sheet on which the toner image is formed by the image forming unit;

a conveying unit that conveys the sheet on which the toner image is formed from the image forming unit to the post-processing unit;

a discharge member that is arranged between the image forming unit and the post-processing unit in a sheet conveying direction, and discharges static electricity from the sheet that is conveyed by the conveying unit;

a voltage applying unit that applies to the discharge member a discharge voltage for discharging static electricity from the sheet; and a control unit that accelerates a conveying speed of the sheet when the discharge voltage is applied by the voltage applying unit, and controls the conveying unit to vary acceleration timing for accelerating the conveying speed of the sheet in accordance with a type of the post-processing.

2. The image forming system according to claim 1, wherein, in a case in which the type of the post-processing is saddle stitching processing, the acceleration timing coincides with a timing at which static electricity is discharged by the discharge member from an area of the sheet, the area including a folding portion provided by the saddle stitching processing.

3. The image forming system according to claim 1, wherein, in a case in which the type of the post-processing is center folding processing, the acceleration timing coincides with timing at which static electricity is discharged by the discharge member from an area of the sheet, the area including a folding portion provided by the center folding processing.

4. The image forming system according to claim 1, wherein, in a case in which the type of the post-processing is side stitching processing, the acceleration timing coincides with a timing at which static electricity is discharged by the discharge member from an area of the sheet, the area being provided by the side stitching processing and being in a binding portion side from a center position in a sheet conveying direction.

5. The image forming system according to claim 1, wherein the control unit determines whether to vary the acceleration timing in accordance with a type of the sheet.

6. The image forming system according to claim 1, wherein the control unit determines whether to vary the acceleration timing in accordance with coverage of a toner image formed on the sheet by the image forming unit.

7. The image forming system according to claim 1, wherein the control unit determines whether to apply the discharge voltage to the discharge member at the acceleration timing in accordance with a change of the conveying speed between before and after accelerating the conveying speed of the sheet.

8. The image forming system according to claim 1, wherein the control unit performs control to selectively execute an acceleration mode and a constant speed mode, the acceleration mode accelerating the conveying speed of the sheet when the discharge voltage is applied by the voltage applying unit, the constant speed mode not accelerating the conveying speed of the sheet when the discharge voltage is applied by the voltage applying unit.

9. A conveying control method in an image forming system comprising:

an image forming unit that forms a toner image on a sheet;

a post-processing unit that performs post-processing to the sheet on which the toner image is formed by the image forming unit;

a conveying unit that conveys the sheet on which the toner image is formed from the image forming unit to the post-processing unit;

a discharge member that is arranged between the image forming unit and the post-processing unit in a sheet conveying direction, and discharges static electricity from the sheet that is conveyed by the conveying unit; and a voltage applying unit that applies to the discharge member a discharge voltage for discharging static electricity from the sheet, the conveying control method comprising controlling the conveying unit, when the discharge voltage is applied by the voltage applying unit, to accelerate a conveying speed of the sheet, and to vary acceleration timing for accelerating the conveying speed of the sheet in accordance with a type of the post-processing.

* * * * *